US006006858A

United States Patent [19]

Shima et al.

[11] Patent Number: 6,006,858

[45] Date of Patent: Dec. 28, 1999

[54] NOISE CONTROL APPARATUS

[75] Inventors: Hiroshi Shima; Toshiyuki Watanabe, both of Tokyo, Japan

[73] Assignee: Bridgestone Corporation, Tokyo, Japan

[21] Appl. No.: 09/244,633

[22] Filed: Feb. 4, 1999

[30] Foreign Application Priority Data

Feb. 5, 1998 [JP] Japan ..... 10-039552
Aug. 6, 1998 [JP] Japan ..... 10-223087

[51] Int. Cl.[6] ..... G10K 11/00

[52] U.S. Cl. ..... 181/210

[58] Field of Search ..... 181/210, 284, 181/286, 287; 52/144, 145, 169.3, 169.4

[56] References Cited

U.S. PATENT DOCUMENTS 5,678,364 10/1997 Shima et al. ..... 181/210

5,739,482 4/1998 Shima et al. ..... 181/210

*Primary Examiner*—Khanh Dang

*Attorney, Agent, or Firm*—Jordan and Hamburg LLP

[57] ABSTRACT

A noise control apparatus adapted for installation on top of a straight upright sound barrier, existing or newly erected, is provided which comprises a main body formed from a first screen inclined towards a sound source and a second screen inclined away from the sound source to have a generally V-shaped cross section; the first screen having formed at the top thereof a first additional screen inclined away from the sound source; the second screen having formed at the top thereof a second additional screen inclined towards the sound source; and the distance between free ends of the first and second additional screens being 55 to 88% of that between the tops of the first and second screens. This sound barrier structure has a highly improved effect of noise control while being very compact and lightweight.

5 Claims, 9 Drawing Sheets

NOISE CONTROL APPARATUS

BACKGROUND OF THE INVENTION

1. Field of the Invention

The present invention relates to a noise control apparatus for use on top of a straight upright sound barrier provided to reduce noises emanating from road, railway, factory, etc.

2. Description of Related Art

FIG. 1 shows a typical conventional noise control apparatus for use on top of a straight upright sound barrier or screen, existing or newly erected, which will be referred to as "main sound barrier" for the convenience of the explanation hereinunder). As seen, the noise control apparatus comprises a main sound barrier 100, a first additional screen 101 installed on top of the main sound barrier and tilted towards a sound source, and a second additional screen 102 installed atop the main sound barrier and tilted away from the sound source (namely, towards protected area). As will be understood from FIG. 1, the main sound barrier 100, first and second additional screens 101 and 102 form together a structure having a Y-shaped cross section. This Y-shaped structure reduces noise rather more effectively than a straight upright sound barrier or screen having a same height.

The conventional Y-structure of sound barrier has been required for an improved capability of sound attenuation and further compact and lightweight design. Especially, since there is a regulation in Japan that the upper portion of the sound barrier of this type for use along the roadway should not overhang more than 0.25 m over the road surface, the sound barrier structure is required to be more compact while maintaining the improved capability of sound attenuation.

SUMMARY OF THE PRESENT INVENTION

Accordingly, the present invention has an object to provide a noise control apparatus having an improved capability of noise attenuation and a compact and lightweight structure.

The above object can be attained by providing a noise control apparatus adapted for installation on top of a straight upright sound barrier, comprising:

- a main body formed from a first screen inclined towards a sound source and a second screen inclined away from the sound source to have a generally V-shaped cross section;
- the first screen having formed at the top thereof a first additional screen inclined away from the sound source;
- the second screen having formed at the top thereof a second additional screen inclined towards the sound source; and
- the distance between free ends of the first and second additional screens being 55 to 88% of that between the tops of the first and second screens.

Because the distance between free ends of the first and second additional screens is 55 to 88% of that between the tops of the first and second screens, the noise control apparatus can reduce noise more effectively and be designed more compact and lightweight.

According to another aspect of the present invention, the distance between the first and second screens may be 0.25 m or more which provides a greater effect of noise reduction.

According a still another aspect of the present invention, a third additional screen may be provided to define two spaces where sound coming from a source is attenuated, thereby reducing noise more effectively.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
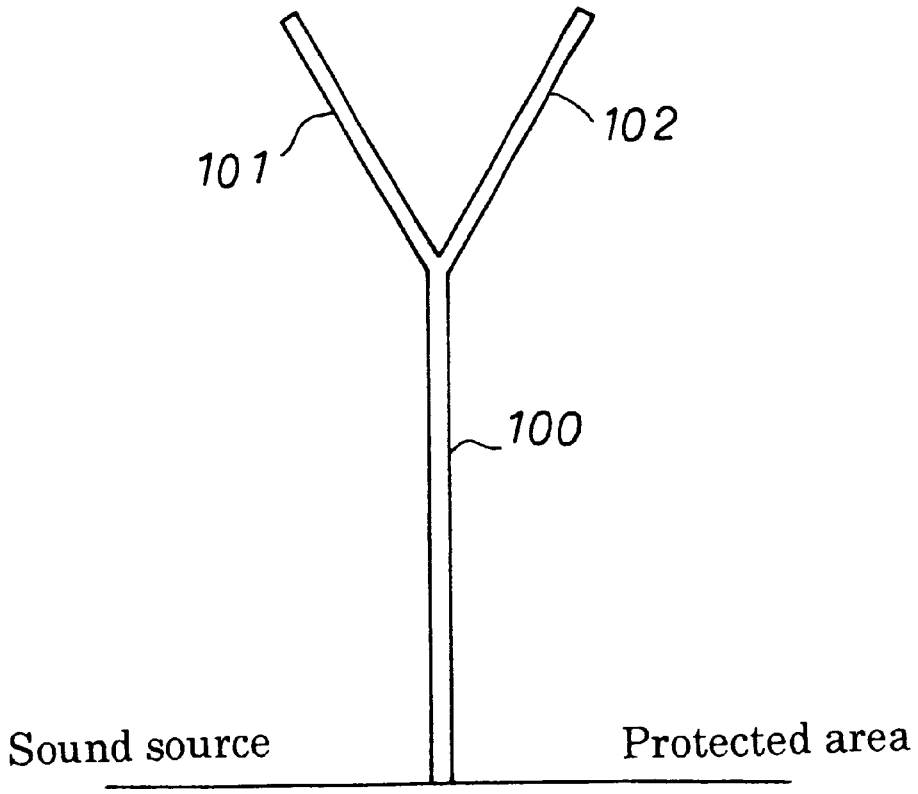
FIG. 1 (PRIOR ART)
FIG. 1 is a schematic side elevation of a conventional sound barrier structure.
Figure 2:
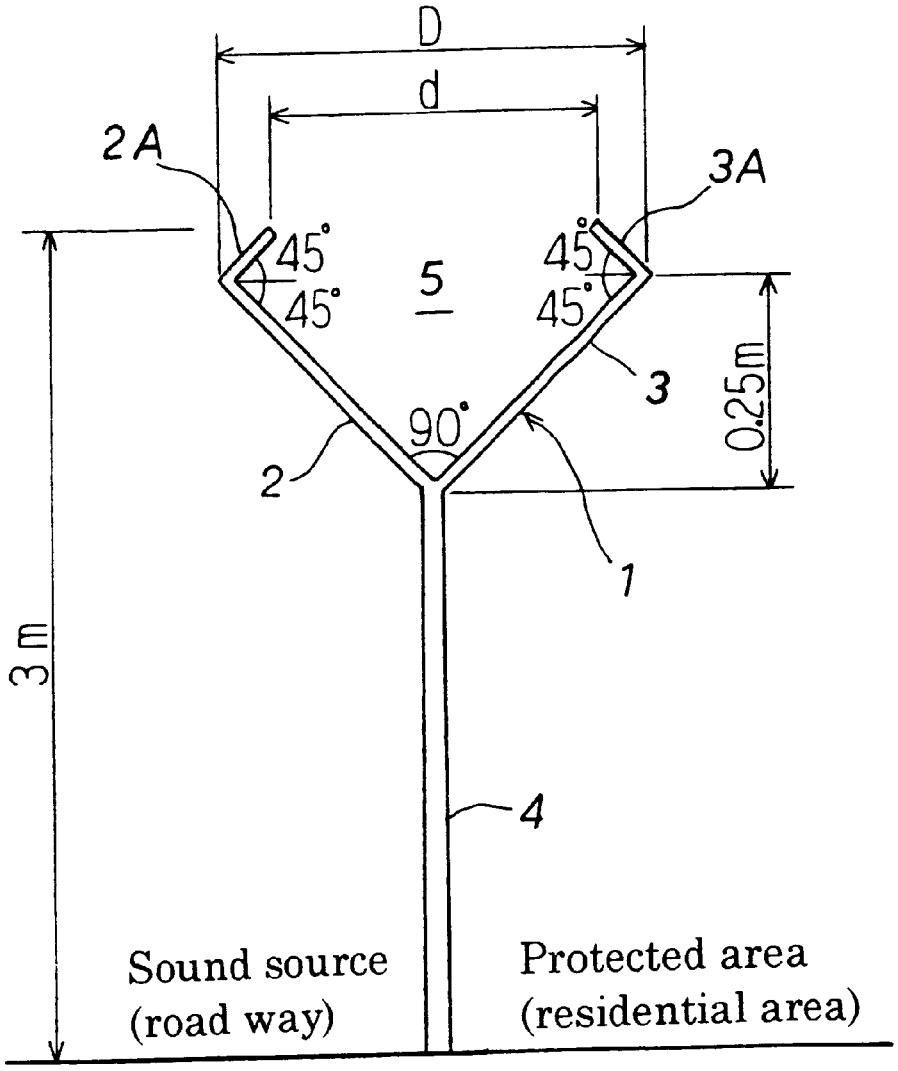
FIG. 2 is a schematic side elevation of one preferred embodiment of the noise control apparatus according to the present invention.

Referring now to FIG. 2, there is illustrated an embodiment of the noise control apparatus according to the present invention. The apparatus comprises a main body generally indicated with a reference 1. It consists of a first screen 2 inclined towards a sound source and a second screen 3 inclined away from the sound source. Thus the main body 1 has a generally V-shaped cross section. It is installed on top of a straight upright sound barrier 4 (will be referred to as "main sound barrier" hereinunder), existing or newly erected. The first screen 2 has a first additional screen 2A formed at the top thereof, and the seconds screen 3 has a second additional screen 3A formed at the top thereof. The distance d between free ends of the first and second additional screens 2A and 3A is 55 to 88% of that D between tops of the first and second screens 2 and 3. The first and second screens 2 and 3 of the main body 1 forming together the V-shaped cross section define an angle of 90 degrees between them. The first additional screen 2A forms an angle of 90 degrees with the first screen 2, and also the second additional screen 3A forms an angle of 90 degrees with the second screen 3. The distances from the tops of the first and second screen 2 and 3 to intersections, respectively, of a line passing through the tops of the first and second screens 2 and 3 with lines passing through free ends of the first and second additional screens 2A and 3A and perpendicular to the line passing through the tops of the first and second screens 2 and 3, are D/6. This embodiment is destined for use as a main sound barrier installed along a roadway, for example. The distance D between the tops of the first and second screens 2 and 3 is 0.25 m or more, and the total height of the noise control apparatus 3 and main sound barrier 4 is 3 m.

In the embodiment shown in FIG. 2, the first and second screens 2 and 3 of the main body 1 defining an inner space 5 may have attached on inner surfaces thereof each a sound absorbing material which should preferably be made of a selected one of rock wool, glass wool, ceramic, gas concrete, etc.

In the embodiment shown in FIG. 2, a noise coming from a highway, for example, is first blocked by the first screen 2, and then diffracted at the top of the first screen 2. It is thus reduced under the diffraction effect, and then blocked by the second additional screen 2A. Further the noise is diffracted at the top of the first screen 2 and free end of the first additional screen 2A, and thus reduced under the diffraction effect. The noise thus reduced turns into the space 5 defined between the first screen 2 and first additional screen 2A, and the second screen 3 and second additional screen 3A. Namely, the noise is blocked in the space 5. The noise goes further and it is diffracted at the free end of the second additional screen 3A. Here, it is also reduced under the diffraction effect. The noise thus considerably attenuated travels away from the source.

Figure 3:
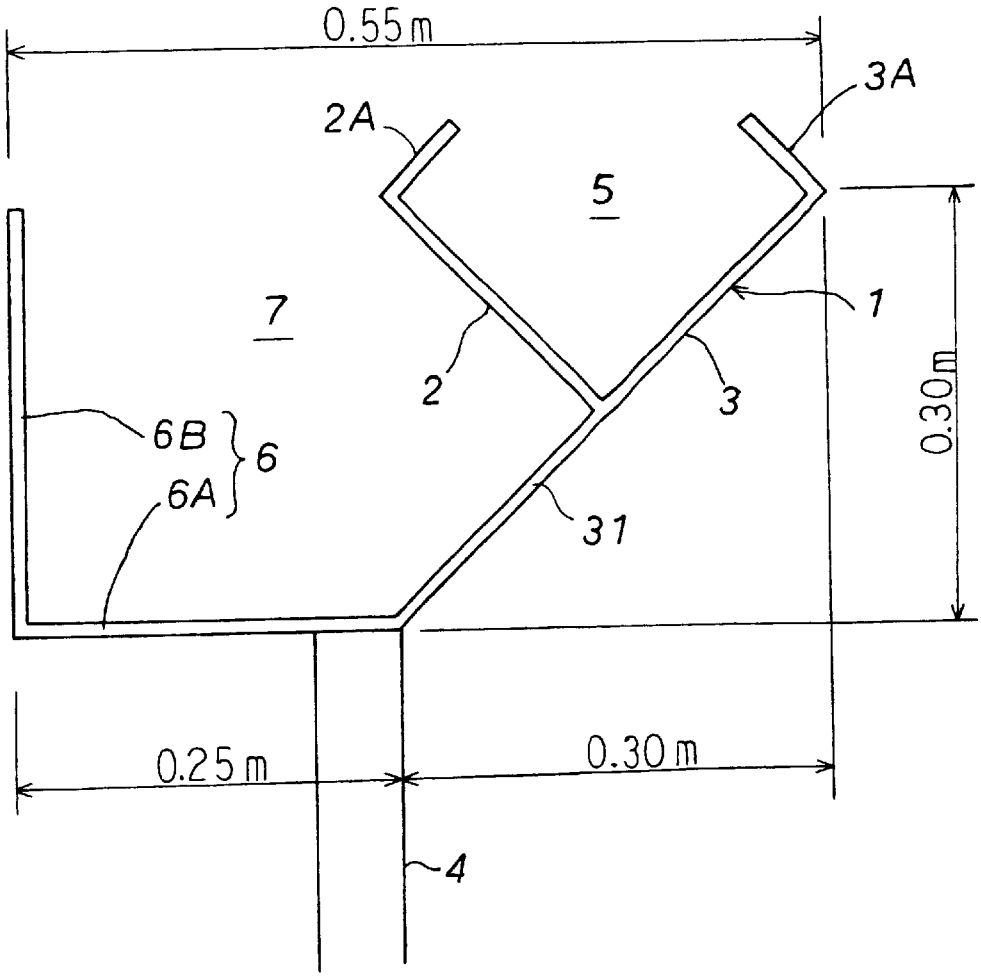
FIG. 3 is a schematic side elevation of a variant of the present invention.

FIG. 3 shows a variant of the noise control apparatus according to the present invention. As seen, this variant has, in addition to the main body 1, a third screen 6 extending a predetermined length towards a sound source and then rising a predetermined length. According to this variant, the main body 1 is installed not directly on top of the main sound barrier 4 but at a position higher than, and offset from, the top of the main sound barrier 4 in a direction away from the sound source. Namely, the second screen 3 is extended (as indicated at 31) straight a predetermined length downward from the intersection with the first screen 2, and the third screen 6 is extended from the lower end of the extension 31 of the second screen 3, as shown. The third screen 6 consists of a portion 6A extending generally horizontally from the top of the main sound barrier 4 towards the sound source, and a portion 6B rising vertically from the free end of the portion 6A. There is defined a space 7 between the third screen 6 and first screen 2. The noise control apparatus is projected 0.25 m towards the sound source from a side of the main sound barrier 4 opposite to the sound source. The noise control apparatus as a whole has a width of 0.55 m.

Figure 4:
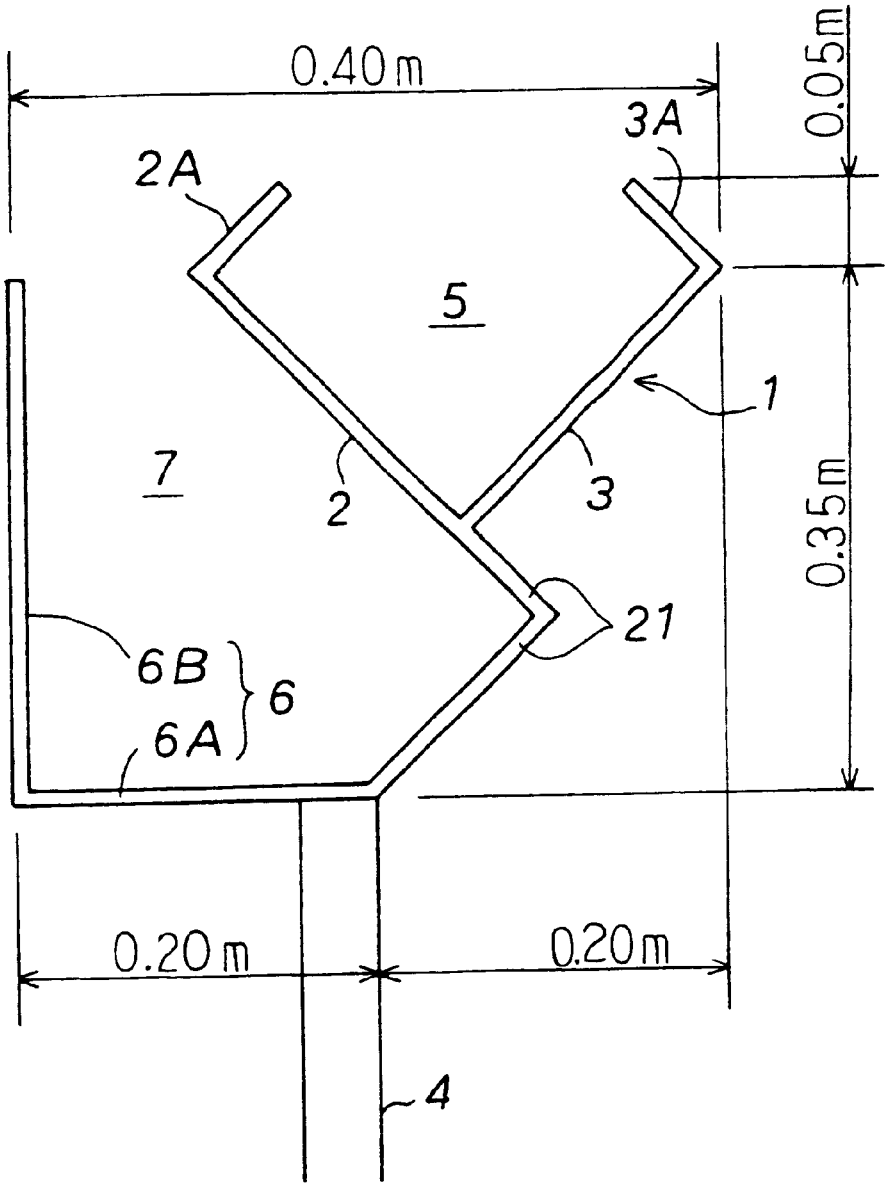
FIG. 4 is a schematic side elevation of another variant of the present invention.

FIG. 4 shows another variant comprising a third screen 6 as in the above-mentioned first variant. In this variant, the first screen 2 is extended (as indicated at 21) straight a predetermined length downward from the intersection with the second screen 3 and then bent at an right angle downward and extending a predetermined length downward, as shown. The third screen 6 has a same structure as in the first variant, and it is contiguous to the lower end of the extension 21 of the first screen 2. The noise control apparatus is projected 0.20 m towards the sound source from a side of the main sound barrier opposite to the sound source. The noise control apparatus as a whole has a width of 0.40 m.

A sound absorbing material may be attached on the inner walls of the spaces 5 and 7 in the first and second variants shown in FIGS. 3 and 4.

For comparison of the first and second variants shown in FIGS. 3 and 4 with the prior art, a straight upright sound barrier of 3 m in height, and the sound barrier structures using the variants and having a same height from the ground level, were erected at a side for field evaluation of their effect of sound reduction. Each of the test sound barrier structures was 20 m long. A speaker directed downward was placed as a sound source at a height of 0.5 m above the ground at a place 7.5 m off the test sound barrier structure. The speaker was a one which can generate a noise of a same frequency as the traffic noise from the roadway or highway. The sound from the speaker was measured at positions as specified in Table 1. The test results are shown in Table 1 as the sound reduction in comparison between the straight upright sound barrier and the variants of the present invention.

TABLE 1

| Measuring point | | Sound reduction (dB) | |
|---|---|---|---|
| Distance from barrier | Height above ground | Variant in FIG. 2 | Variant in FIG. 3 |
| 5 m | 0 m | 2.0 | 1.6 |
| 5 m | 1.2 m | 3.7 | 2.6 |
| 5 m | 3.5 m | 1.6 | 1.1 |
| 5 m | 5 m | 0.7 | 0.2 |
| 10 m | 0 m | 2.7 | 1.8 |
| 10 m | 1.2 m | 2.5 | 2.2 |
| 10 m | 3.5 m | 1.5 | 1.6 |
| 10 m | 5 m | 0.7 | 0.8 |

The sound source used in this test was a one which can generate a sound having a typical spectrum for velocity independent road traffic noise for prediction method, proposed by the Acoustical Society of Japan, namely, a sound represented by the "A-weighted spectrum" shown in Table 2. The typical spectrum is described on page 238 of the Journal of Acoustical Society of Japan Vol. 50 No. 3 (1994) issued by the Acoustical Society of Japan.

TABLE 2

| Frequency (Hz) | Characteristic-A spectrum of traffic noise (dB) |
|---|---|
| 125 | −16.2 |
| 160 | −13.3 |
| 200 | −10.9 |
| 250 | −8.7 |
| 315 | −6.7 |
| 400 | −4.9 |
| 500 | −3.5 |
| 630 | −2.3 |
| 800 | −1.4 |
| 1000 | −1.0 |
| 1250 | −0.9 |
| 1600 | −1.2 |
| 2000 | −1.8 |
| 2500 | −2.8 |
| 3150 | −4.2 |
| 4000 | −6.0 |

Figure 5:
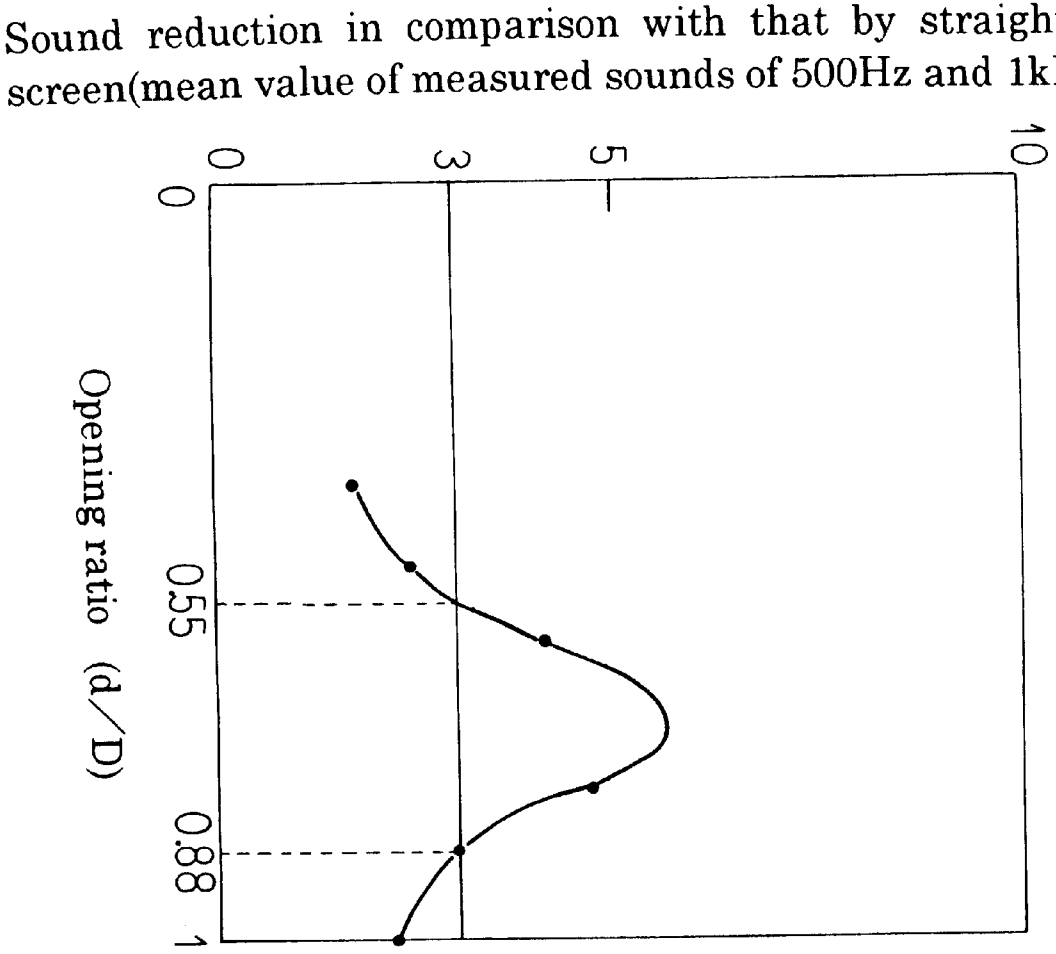
FIG. 5 graphically shows the relationship between an opening ratio (d/D) and sound reduction by the variant of present invention in comparison with that by a straight upright sound barrier.

FIG. 5 graphically shows a relationship between the sound reduction by the variants in comparison with that by the straight upright sound barrier and the ratio between the openings d and D shown in FIG. 2. The center frequencies of traffic noise are 500 Hz and 1 kHz. Thus, the sounds of 500 Hz and 1 kHz in frequency from the source were measured and averaged, respectively. As seen from FIG. 5, when the opening ratio d/D was within a range of 0.55 to 0.88%, the variants of the present invention attained a sound reduction larger by more than 3 dB than that by the straight upright sound barrier.

Figure 6:
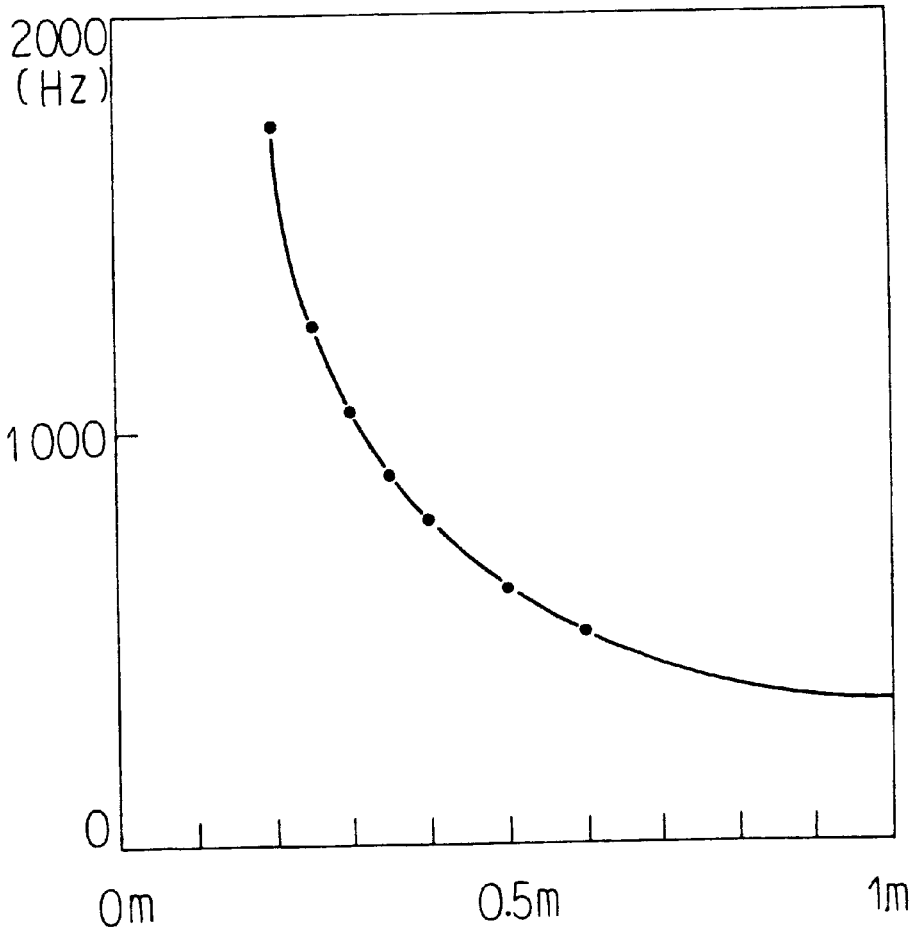
FIG. 6 graphically shows the relationship between the distance between tops of the first and second screens and frequencies effectively reducible by the noise control apparatus.

FIG. 6 also graphically shows a relationship between the size of the opening D and the sound frequency which can be most effectively reduced. As seen, the opening D between the tops of the first and second screens should be at least 0.25 m or more.

Figure 7:
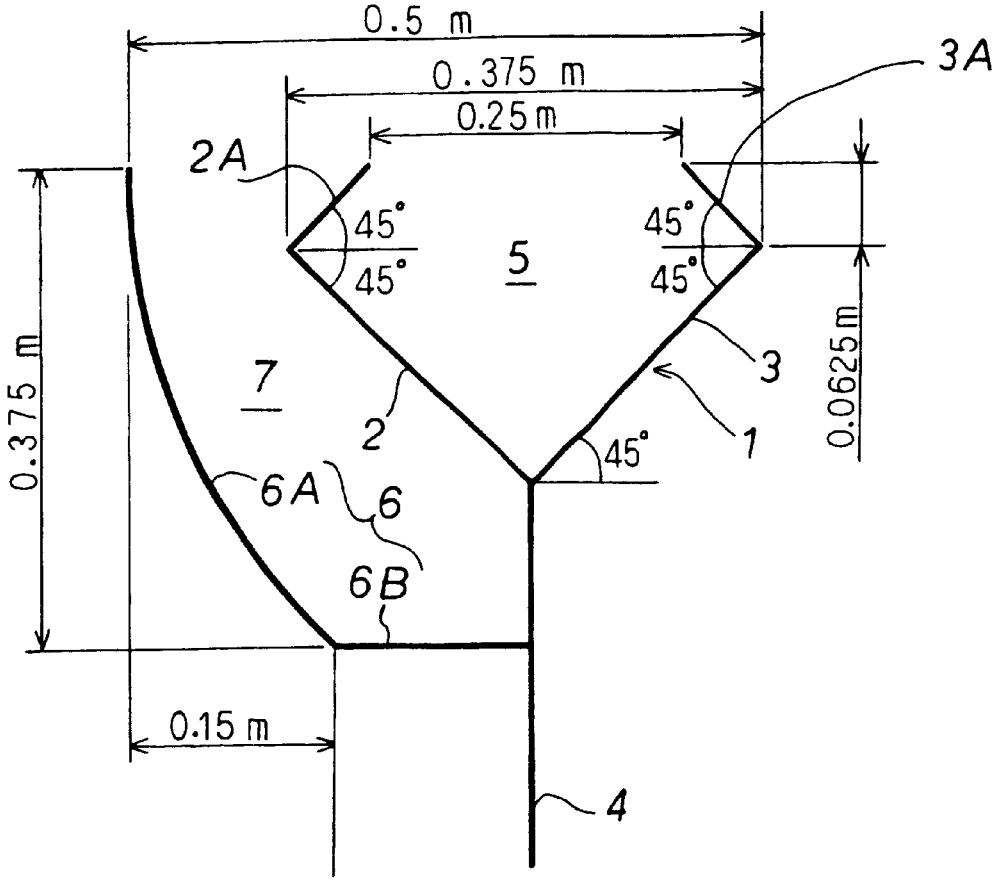
FIG. 7 is a schematic side elevation of a still another variant of the present invention, provided with the third additional screen having a modified shape.

FIG. 7 shows a still another variant of the present invention also comprising a third screen 6 which has however a modified form. Namely, the first portion 6A of the third screen 6 corresponding to the second portion 6B in the first and second variants is formed to have an arcuate cross section bulging towards the sound source, as shown. This bulging form will enhance the esthetical appearance of the noise control apparatus.

Figure 8:
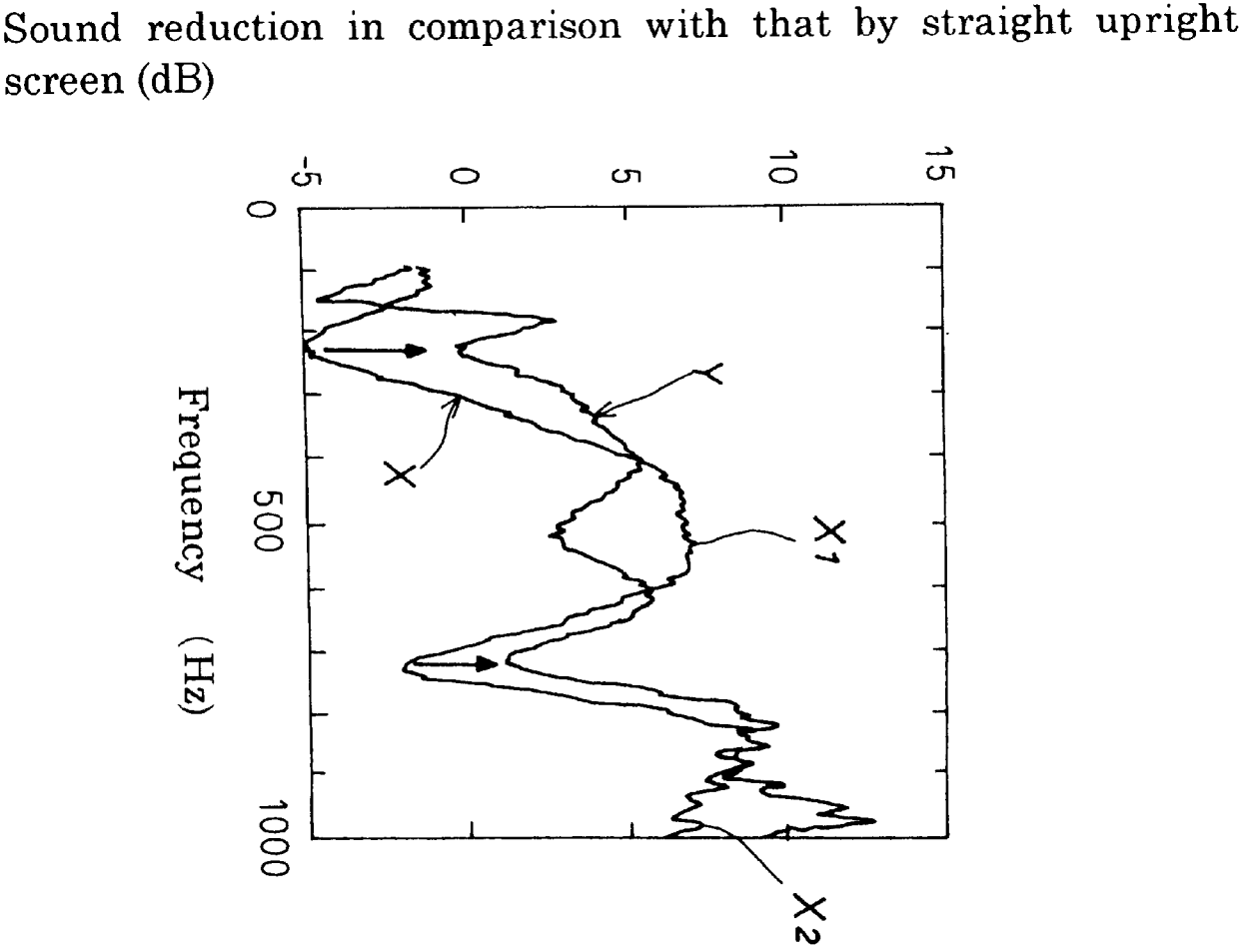
FIG. 8 graphically shows the relationship between the sound reduction by the variants in FIGS. 2 and 7 in comparison with that by the straight upright sound barrier.
Figure 9:
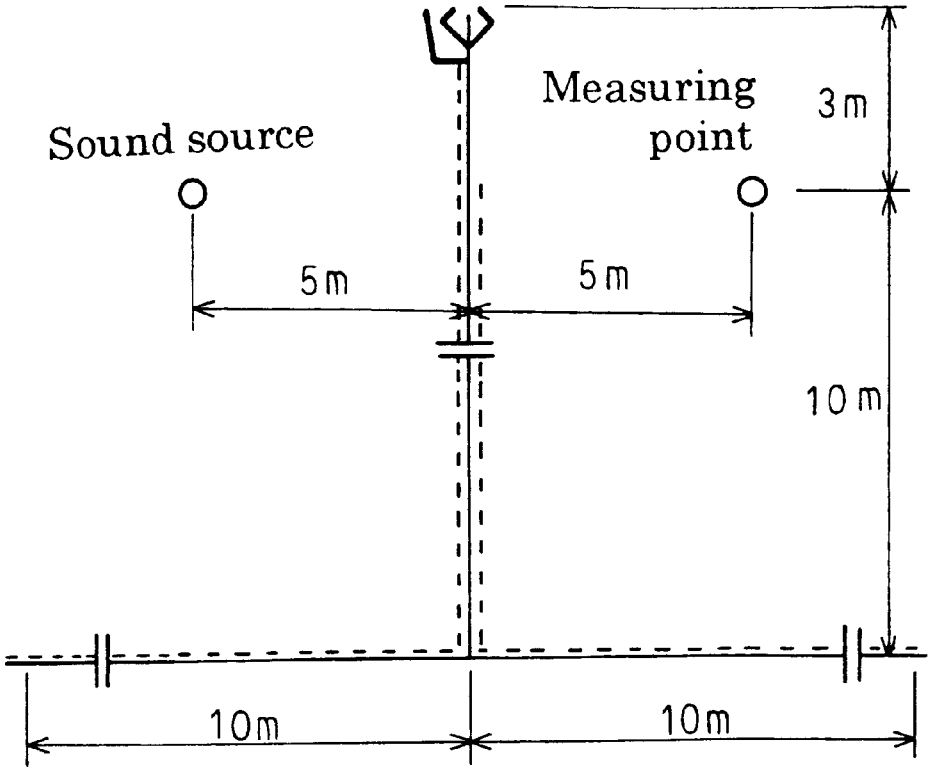
FIG. 9 shows the method of calculation used to prepare the graph in FIG. 8.

FIG. 8 graphically shows a relationship between the sound reduction attained by the variants of the present invention in comparison with that by the straight upright sound barrier, as shown in FIG. 7, and the frequency characteristics of the sounds reduced by the variants. The two dimensional boundary element method is used to calculate the frequency characteristic under the conditions specified in FIG. 9. In FIG. 9, the broken line indicates a complete sound absorbing boundary when normal acoustical impedance Z is $Z_0=\sigma_0 C_0$ where $\sigma_0$:density of air; $C_0$:sound velocity in air. The basic noise control apparatus, variant shown in FIG. 2, having a width of 375 mm (this numerical value is indicated in FIG. 7) and the cross-sectional form of a pentagon, reduced, by 5 dB or more, sounds of nearly 500 Hz and 1 kHz. However, the sounds of about 230 Hz and 720 Hz could not be well reduced by the variant due to a resonance (as indicated with a reference X in FIG. 8). A counter-resonator of ¼ or ¾ wavelength can be used to cancel such a resonance at the frequency of 230 Hz or 720 Hz, respectively. As in the first to third variants, the third screen 6 is provided to define the space 7 between it and the first screen 2. The space 7 served as the counter-resonators and could effectively prevent such resonance. In FIG. 8, the curve indicated with a reference X is for the embodiment shown in FIG. 2, and the curve indicated with a reference Y is for the third variant shown in FIG. 7. As seen, the variant with the third screen 6 could well reduce the sound of 200 Hz or higher in frequency without any deteriorated effect of sound reduction.

Now the mechanism of the counter-resonator will be discussed below. In the embodiment shown in FIG. 2, the sound reduction is lowered against the sounds of 230 Hz and 720 Hz in frequency due to a resonance in the space 5. To avoid such a resonance, the sound pressure levels of the frequencies should be lowered before the sound comes into the space 5, namely, in the space 7 as in the third variant shown in FIG. 7. More particularly, the space 7 has a depth corresponding to ¼ to ¾ wavelength of a frequency. A sound coming into the space 7, reflected at the bottom of the space 7 and then going out of the space 7 will have the phase thereof shifted by $\pi$ when the space depth of ¼ wavelength or by $3\pi$ when the space depth is ¾ wavelength. Thus, a sound going directly to the free end of the first additional screen 2A and a sound having the phase thereof thus shifted will cancel each other, so that the sound pressure level of the frequency can be lowered.

What is claimed is:

1. A noise control apparatus adapted for installation on top of a straight upright sound barrier, comprising:

a main body formed from a first screen inclined towards a sound source and a second screen inclined away from the sound source to have a generally V-shaped cross section;

the first screen having formed at the top thereof a first additional screen inclined away from the sound source;

the second screen having formed at the top thereof a second additional screen inclined towards the sound source; and the distance between free ends of the first and second additional screens being 55 to 88% of that between the tops of the first and second screens.

2. The noise control apparatus according to claim 1, wherein the distance between the first and second screens is about 0.25 m or more.

3. The noise control apparatus according to claim 1, wherein a third screen inclined towards the sound source and extending upward is provided.

4. The noise control apparatus according to claim 3, wherein the third screen is at least as high as the first screen to define together with the first screen a space which forms a counter-resonator.

5. The noise control apparatus according to claim 3 or 4, wherein the third screen is formed to have an arcuate cross section bulging towards the sound source.

* * * * *